US009581366B2

(12) United States Patent
Cho

(10) Patent No.: US 9,581,366 B2
(45) Date of Patent: Feb. 28, 2017

(54) AIR CONDITIONER

(75) Inventor: Eun Jun Cho, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1301 days.

(21) Appl. No.: 13/382,854

(22) PCT Filed: Jun. 10, 2010

(86) PCT No.: PCT/KR2010/003722

§ 371 (c)(1),
(2), (4) Date: Mar. 23, 2012

(87) PCT Pub. No.: WO2011/004970

PCT Pub. Date: Jan. 13, 2011

(65) Prior Publication Data

US 2012/0174615 A1 Jul. 12, 2012

(30) Foreign Application Priority Data

Jul. 7, 2009 (KR) ..... 10-2009-0061813

(51) Int. Cl.

| | |
|---|---|
| ***F25B 43/02*** | (2006.01) |
| ***F25B 31/00*** | (2006.01) |
| ***F25B 40/02*** | (2006.01) |

(52) U.S. Cl.

CPC ..... *F25B 31/004* (2013.01); *F25B 40/02* (2013.01); *F25B 2339/047* (2013.01); *F25B 2400/13* (2013.01)

(58) Field of Classification Search

CPC .... F25B 40/02; F25B 40/06; F25B 2339/044; F25B 2400/05; F25B 7/00; F25B 39/02; F25B 2339/041

See application file for complete search history.

(56) References Cited

U.S. PATENT DOCUMENTS

| | | | | |
|---|---|---|---|---|
| 4,715,196 | A * | 12/1987 | Sugiura | 62/468 |
| 5,761,914 | A * | 6/1998 | Carey et al. | 62/84 |
| 7,114,349 | B2 * | 10/2006 | Lifson et al. | 62/513 |

FOREIGN PATENT DOCUMENTS

| | | | |
|---|---|---|---|
| EP | 1939548 | A1 | 7/2008 |
| JP | 2002-156161 | | 5/2002 |
| JP | 2004-170048 | | 6/2004 |
| JP | 2004170048 | A | 6/2004 |
| KR | 2008-0082357 | | 9/2008 |
| KR | 10-0863351 | | 10/2008 |
| KR | 100883600 | B1 | 2/2009 |

* cited by examiner

*Primary Examiner* — Jonathan Bradford
*Assistant Examiner* — Elizabeth Martin
(74) *Attorney, Agent, or Firm* — Dentons US LLP

(57) ABSTRACT

An air conditioner having a first circulation channel which drives a thermodynamic cycle while normally circulating a refrigerant, a second circulation channel which is branched from an outlet of a condenser of the first circulation channel to recover oil from the refrigerant to a compressor and to cause the refrigerant to pass through a supercooling heat exchanger, and a third circulation channel which is directly branched from an evaporator of the first circulation channel to recover oil from the refrigerant and to the compressor and to cause the refrigerant to pass through the supercooling heat exchanger, thereby preventing the wet compression of the compressor to achieve improved reliability of the compressor, and preventing the degradation of heat-exchange performance.

7 Claims, 6 Drawing Sheets

AIR CONDITIONER

This Application is a 35 U.S.C. §371 National Stage Entry of International Application No. PCT/KR2010/003722, filed on Jun. 10, 2010, which claims the benefit of priority of Korean Application No: 10-2009-0061813, filed Jul. 7, 2009, both of which are hereby incorporated by reference in their entirety for all purposes as if fully set forth herein.

TECHNICAL FIELD

The present invention relates to an air conditioner, and more particularly, to an air conditioner comprising a first circulation channel which drives a thermodynamic cycle while normally circulating a refrigerant, a second circulation channel which is branched from an outlet of a condenser of the first circulation channel to recover oil from the refrigerant to a compressor and to cause the refrigerant to pass through a supercooling heat exchanger, and a third circulation channel which is directly branched from an evaporator of the first circulation channel, to recover oil from the refrigerant and send the same to the compressor, and to cause the refrigerant to pass through the supercooling heat exchanger, thereby preventing the wet compression of the compressor to achieve improved reliability of the compressor.

BACKGROUND ART

In general, an air conditioner is a cooling/heating device which cools an indoor area by repeatedly performing an operation of sucking indoor hot air, heat-exchanging it with a low temperature refrigerant, and discharging the same to the indoor area, or heats the indoor area through the opposite operation. The air conditioner includes a compressor, a condenser, an expansion instrument, and an evaporator to form a series of cycle circulating a refrigerant.

Here, the compressor is a device for compressing a refrigerant at a high temperature and high pressure. To this end, essentially, oil in a fine particle form is mixed with the refrigerant. However, when the mixed refrigerant is introduced into the evaporator, it forms an oil film on a surface of a heat exchanging pipe disposed therein, degrading heat exchange efficiency of the evaporator.

Meanwhile, in order to enhance refrigerant heat exchange performance within the evaporator, a supercooling heat exchanger is installed between the condenser and the expansion instrument in order to further cool the refrigerant before the refrigerant is introduced to the evaporator through the expansion instrument from the condenser, in some cases.

However, although the supercooling heat exchanger advantageously enhances the refrigerant heat exchange performance within the evaporator, heat released from the supercooling heat exchanger after heat-exchanging with the refrigerant is discarded helplessly, resulting in an increase in a loss of energy due to the installation of the supercooling heat exchanger.

DISCLOSURE

Technical Problem

Therefore, an object of the present invention is to provide an air conditioner in which a first circulation channel of a refrigerant generally constituting a thermodynamic cycle is disposed to pass through a supercooling heat exchanger, and a second circulation channel branched from outlet of a condenser and a third circulation channel directly branched from an evaporator are disposed to pass through the supercooling heat exchanger in a crossing manner to overheat a refrigerant and oil by using heat discarded from the supercooling heat exchanger and recover the same to a compressor, thereby enhancing heat exchange performance of the refrigerant within the evaporator and preventing an energy loss of the supercooling heat exchanger.

Technical Solution

According to an aspect of the present invention, there is provided an air conditioner including: a first circulation channel in which a refrigerant sequentially circulates a compressor, a condenser, an expansion instrument, and an evaporator to implement a refrigerating cycle; a second circulation channel in which the refrigerant is condensed by the condenser, crosses the first circulation channel within a supercooling heat exchanger, and then, is introduced into the compressor; and a third circulation channel in which the refrigerant is branched within the evaporator, crosses the first circulation channel within the supercooling heat exchanger, and then, is introduced into the compressor.

The compressor and the condenser may be connected by a first connection pipe, the condenser and the expansion instrument may be connected by a second connection pipe, the expansion instrument and the evaporator may be connected by a third connection pipe, the evaporator and the compressor may be connected by a fourth connection pipe, and the superheating heat exchanger may be disposed between the condenser and the expansion instrument, may be connected to the condenser by a first intermediate pipe among the second connection pipes, and may be connected to the expansion instrument by a second intermediate pipe among the second connection pipes.

The second circulation channel may be a refrigerant flow channel branched from the first intermediate pipe, disposed to cross the first circulation channel within the supercooling heat exchanger, and connected to the compressor.

The third circulation channel may be a refrigerant flow channel directly branched from within the evaporator, disposed to cross the first circulation channel within the supercooling heat exchanger, and connected to the compressor.

A supercooling expander for expanding the refrigerant introduced after being branched from the first intermediate pipe may be installed in the second circulation channel.

Oil may be mixed in the refrigerant moving along the second circulation channel.

The second circulation channel may be a refrigerant flow path branched from the first intermediate pipe, disposed to cross the first circulation channel within the supercooling heat exchanger, and connected to a direct connection port directly installed in the compressor.

The evaporator may be a shell and tube-type evaporator including a shell forming an internal space from which a refrigerant is evaporated and a tube disposed within the shell and allowing water to pass therethrough so as to be heat-exchanged with the refrigerant in the shell.

An oil recovery unit for recovering oil within the evaporator may be installed in the evaporator, and the third circulation channel may be an oil recovery channel along which the oil recovered from the evaporator moves to the compressor.

The oil recovery channel may be connected to the fourth connection pipe to allow the oil recovered from the evaporator to be overheated through the supercooling heat exchanger and then introduced into the compressor.

Advantageous Effects

According to embodiments of the present invention, since oil is immediately recovered to the compressor by using the second and third circulation channels, heat exchange performance within the evaporator can be enhanced.

In addition, since oil recovered to the compressor through the second and third circulation channels is overheated through the supercooling heat exchanger, preventing wet compression of the compressor, and thus enhancing the performance of the compressor.

BEST MODES

An air conditioner according to embodiments of the present invention will be described in detail with reference to the accompanying drawings.

Figure 1:
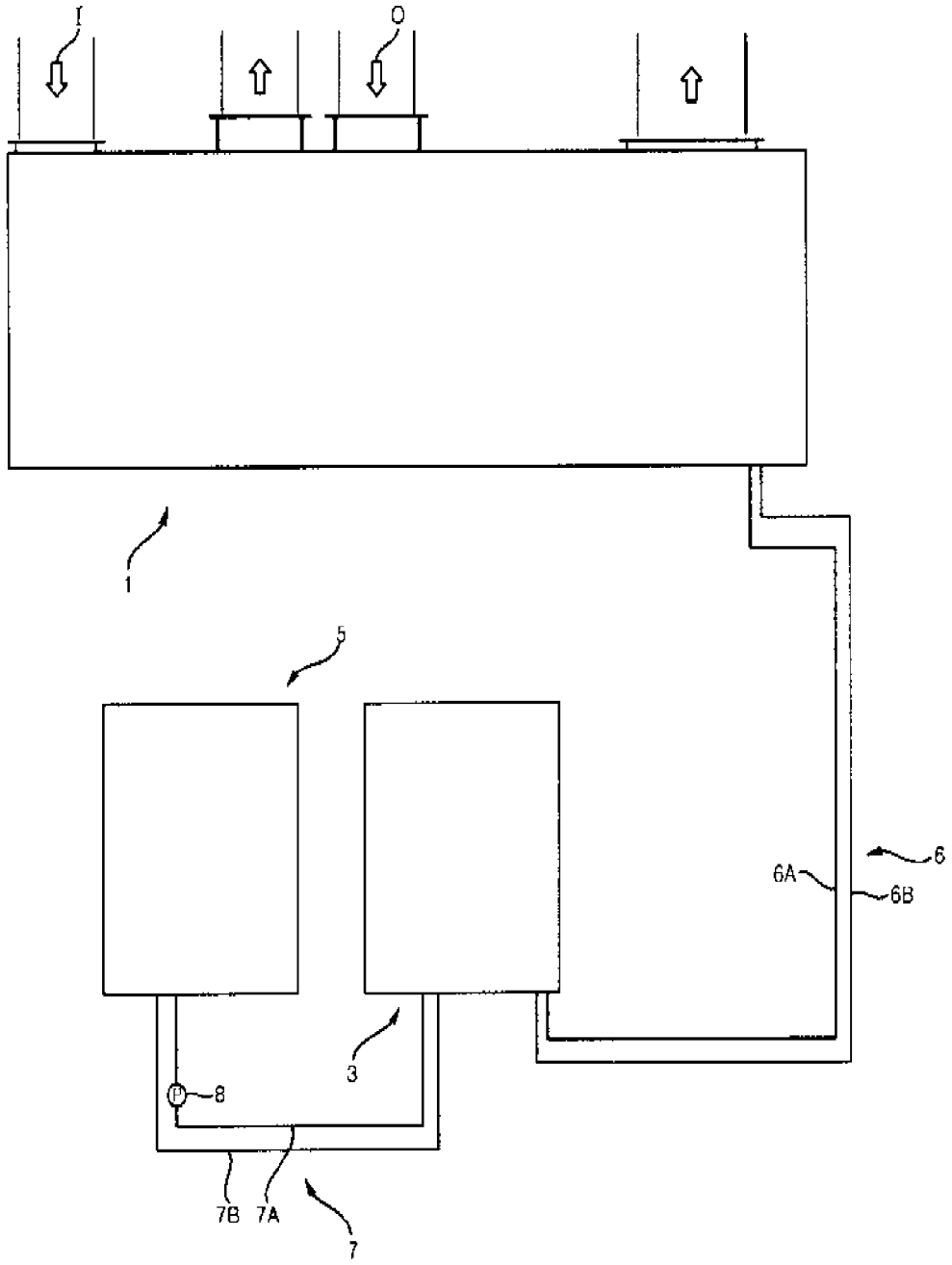
FIG. 1 is a schematic view showing the configuration of an air conditioner according to an embodiment of the present invention.

FIG. 1 is a schematic view showing the configuration of an air conditioner according to an embodiment of the present invention.

The air conditioner according to an embodiment of the present invention includes an air handling unit 1, a chiller 3, and a cooling top 5. The air handling unit 1 and the chiller 3 are connected by a water pipe 6, and the chiller 3 and the cooling top 5 is connected by a coolant pipe 7.

The air handling unit 1 is an air conditioning unit sucking indoor air, heat-exchanging it, and then, discharging the heat-exchanged air to an indoor area. The air handling unit 1 may be configured as a combination ventilation and air-conditioning unit or as a non-ventilation air-conditioning unit.

When the air handling unit 1 is configured as a combination ventilation and air conditioning unit, it sucks indoor air and outdoor air, discharges a portion of the sucked indoor air to the outside, mixes remaining indoor air with outdoor air, heat-exchanges the mixed air to a location requiring cold water (referred to as a 'cold water coil', hereinafter) such as a cold water coil, or the like, and then, supplies the heat-exchanged air to the indoor area, and when the air handling unit 1 is configured as a non-ventilation air conditioning unit, it sucks the indoor air, heat-exchanges the sucked air in the cold water coil, and then, supplies the heat-exchanged air to the indoor area.

The air handling unit 1 includes a cold water coil having a water flow channel allowing water to pass therethrough and blow fans 27 and 28 circulating and blowing a mixture of indoor air and outdoor air or indoor air to the cold water coil.

When the air handling unit 1 is configured as a combination ventilation and air conditioning unit, it may be installed in an air-conditioning chamber, a mechanic chamber, or the like, separately prepared from the indoor area air-conditioned by the air handling unit 1 in a building or a house in which the air conditioner is installed, or may be installed in an outdoor area.

When the air handling unit 1 is configured as a non-ventilation and air conditioning unit, it may be configured as a fan coil unit (FCU) installed in an indoor area air-conditioned by the air handling unit 1, directly sucks indoor air to heat-exchange it in the cold water coil, and directly discharges the heat-exchanged air to the indoor area.

Meanwhile, the chiller 3 is a sort of cold water supply unit which supplies cold water to the cold water coil of the air handling unit 1 by using a refrigerating cycle comprised of a compressor, a condenser, an expansion instrument, and an evaporator. The chiller 3 may be installed in a mechanic chamber such as a basement, or the like, in which the air conditioner is installed, or may be installed in an outdoor area. In the chiller 3, the water pipe 6 is connected to the evaporator, and the coolant pipe 7 is connected to the condenser.

The water pipe 6 includes a cold water outflow pipe 6A allowing cold water of the chiller 3 to be supplied to the air handling unit 1 and a cold water recovery pipe 6B allowing cold water which has passed through the air handling unit 1 to be recovered to the chiller 3.

A cold water pump (not shown) for circulating cold water through the evaporator and the cold water coil is installed in the water pipe 6.

The coolant pipe 7 includes a coolant inlet pipe 7A allowing a coolant of the cooling top 5 to be introduced into the condenser and a coolant outlet pipe 7B allowing the coolant flowing out from the condenser of the chiller 3 to be recovered into the cooling top 5.

A coolant pump 8 for pumping the coolant to allow the coolant to be circulated through the cooling top 5 and the condenser of the chiller 3 is installed on the coolant pipe 7.

The coolant pump 8 is connected to a controller 74 (to be described) s as to be controlled.

Figure 2:
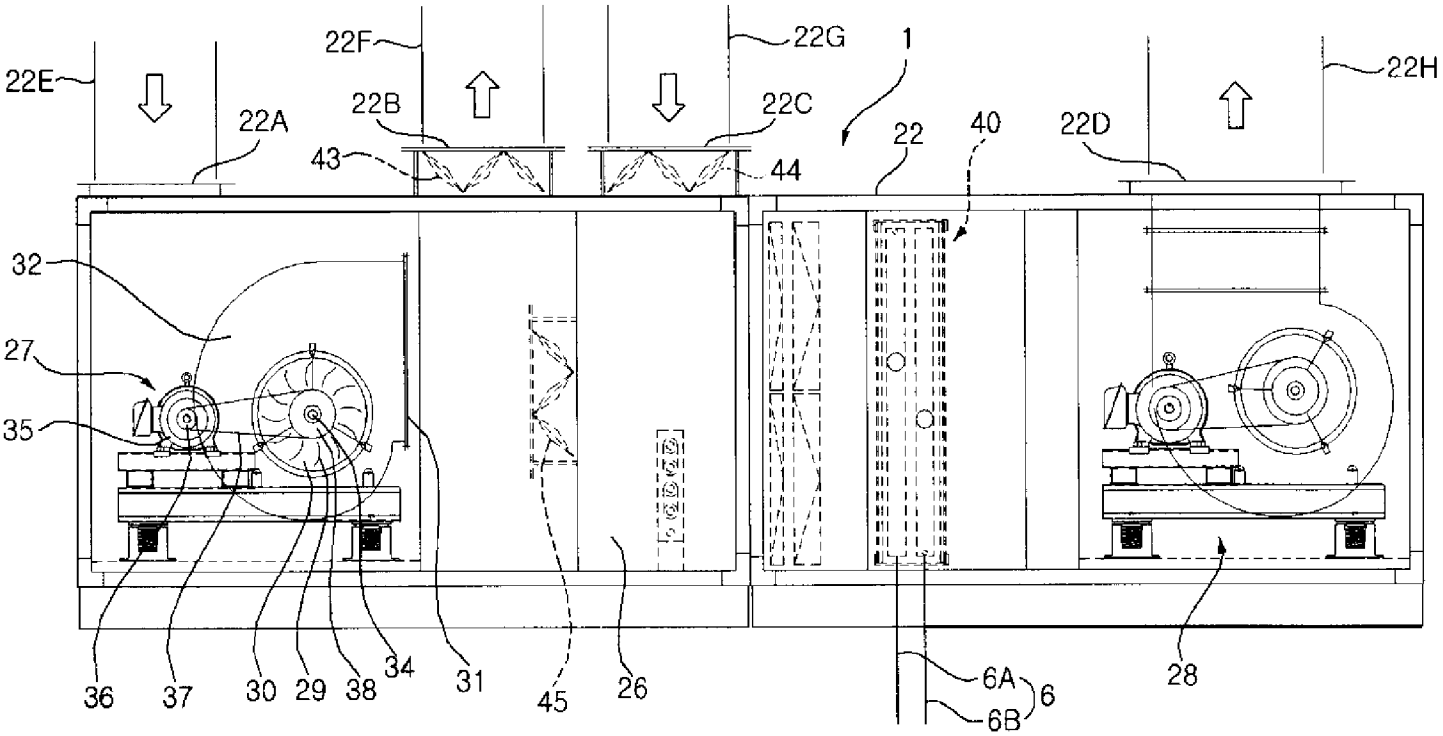
FIG. 2 is a side view of an air handling unit illustrated in FIG. 1.

FIG. 2 is a side view of the air handling unit illustrated in FIG. 1.

The air handling unit 1 will be described in more detail as follows. The air handling unit 1 includes a handling unit case 22 having a space therein and including an indoor air suction unit 22A, an indoor air discharge unit 22B, an outdoor air suction unit 22C, and an air conditioned air discharge unit 22D, blow fans 27 and 28 installed within the air handling unit case 22 and moving outdoor air and indoor air, and a cold water coil 40 installed within the air handling unit case 22 and heat-exchanging air moving toward the air conditioned air discharge unit 22D with cold water.

A ventilation duct 22E is connected to the air handling unit 1 in order to allow the indoor area and the indoor air suction unit 22A to communicate therethrough, whereby indoor air is sucked into the air handling unit case 22 through the indoor air suction unit 22A, an exhaust duct 22F is connected to the air handling unit 1 in order to allow the indoor air discharge unit 22B and the outdoor area to communicate therethrough, whereby a portion of air sucked into the air handling unit case 22 through the indoor air suction unit 22A is discharged to an outdoor area, an external air duct 22G is connected to the air handling unit 1 in order to allow the outdoor area and the outdoor air suction unit 22 to communicate therethrough, whereby outdoor air is sucked into the air handling unit case 22 through the outdoor air suction unit 22C, and an air supply duct 22H is connected to the air handling unit 1 in order to allow the air-conditioned air discharge unit 22D and the indoor area to communicate therethrough, whereby air air-conditioned within the air handling unit case 22 is supplied to the indoor area.

The ventilation duct 22E is connected to the indoor air suction unit 22A. The exhaust duct 22F is connected to the indoor air discharge unit 22B. The external air duct 22G is connected to the outdoor air suction unit 22C. The air supply duct 22H is connected to the air-conditioned air discharge unit 22D.

The air handling unit 1 is configured such that a portion of indoor air sucked through the indoor air suction unit 22A is exhaust to the outdoor area through the indoor air discharge unit 22B, the remaining indoor air is mixed with outdoor air sucked through the outdoor air suction unit 22C, and the mixed air is heat-exchanged with the cold water coil 40, and then, supplied to the indoor area through the air-conditioned air discharge unit 22D and the air supply duct 22H. In the air handling unit 1, a mixing chamber 26 in which indoor air and outdoor air are mixed is positioned before the cold water coil 40 in an air movement direction.

The blow fans 27 and 28 include a return fan 27 positioned between the indoor air suction unit 22A and the indoor air discharge unit 22B in the direction in which indoor air moves, to suck indoor air into the air handling unit case 22 and blow it, and a supply fan 28 positioned between the cold water coil 40 and the air-conditioned air discharge unit 22D in a direction in which mixed air moves, to suck mixed air into the cold water coil 40 and blow it toward the air-conditioned air discharge unit 22D.

The blow fans 27 and 28 are air volume variable blow fans which can adjust an air volume and include a blower 29, a housing 32 including an air suction hole 30 and an air discharge hole 31 formed to surround the blower 29, and a blower driving source (no reference numeral is used) rotating the blower 29.

The blower driving source may be configured as a motor having a rotational shaft connected to a rotation center of the blower 29, and may be comprised of a shaft 34 connected to the rotation center of the blower 29, a motor 35 installed to be positioned at an outer side of the housing 32, and a power transmission member including a driving pulley 36, a belt 37, and a follower pulley 38 to transmit power of the motor 35 to the shaft 34.

The motor 35 may be configured as an inverter motor which can vary a wind speed.

The cold water coil 40 is a sort of an indoor heat exchanger heat-exchanging mixed air and cold water to cool mixed air. The cold water coil 40 is installed between the mixing chamber 26 and the supply fan 27.

The air handling unit 1 includes dampers 43, 44, and 45 which regulate the ratio between indoor air and outdoor air of the mixed air.

The dampers 43, 44, and 45 include an exhaust damper 43 installed in the indoor air discharge unit 22B to regulate indoor air exhaust amount, an external air damper 44 installed in the outdoor air suction unit 22C to regulate outdoor air intake amount, and a mixing damper 45 installed in the mixing chamber 26 to regulate an amount of air, in the indoor air, sucked into the mixing chamber 26

Figure 3:
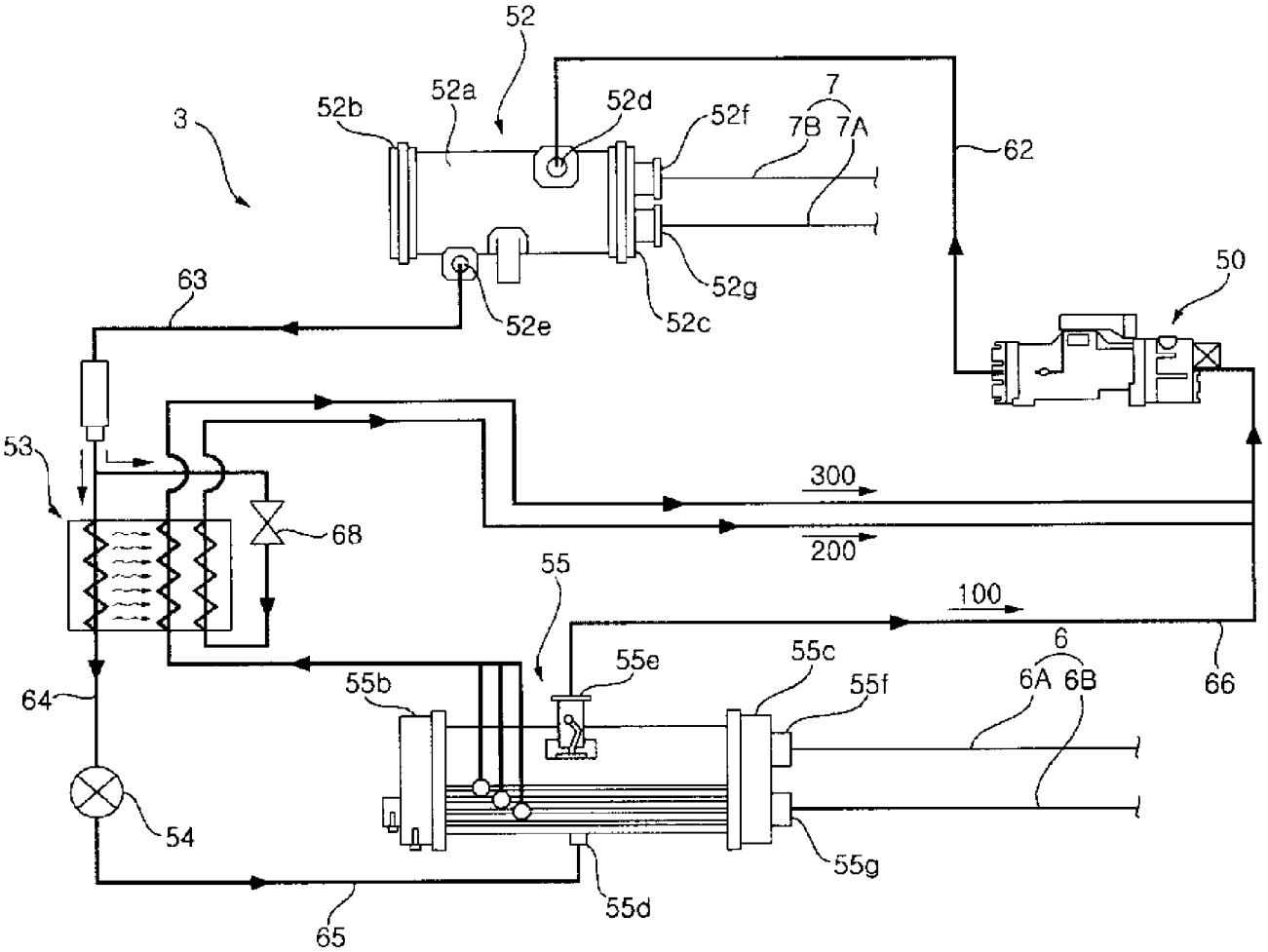
FIG. 3 is a schematic view showing the configuration of a chiller illustrated in FIG. 1.

FIG. 3 is a schematic view showing the chiller illustrated in FIG. 1.

The configuration of the chiller 3 will be described in detail with reference to the accompanying drawings as follows. The chiller 3 includes a compressor 50, a condenser 52, a supercooling heat exchanger 53, an expansion instrument 54, and an evaporator 55. The compressor 50, the condenser 52, the supercooling heat exchanger 53, the expansion instrument 54, and the evaporator 55 are installed within a single chiller case so as to be integrated into a single unit.

The compressor 50 compresses a refrigerant. The compressor 50 may be configured as a capacity variable compressor whose compression capacity is varied, or may be configured as a constant speed compressor whose compassion capacity is fixed. The compressor 50 may be configured as a reciprocal compressor, a rotary compressor, an inverter compressor, a screw compressor, or the like.

Also, although not shown, it is natural that the compressor 50 may include a plurality of compressors such as a first compressor compressing a refrigerant and a second compressor compressing a refrigerant which has been compressed in the first compressor.

The condenser 52, which condenses a refrigerant by a coolant supplied from the cooling top 5 illustrated in FIG. 1, is a shell-tube-type heat exchanger including a shell 52*a* allowing any one of a refrigerant and water to pass therethrough, a plurality of partitions (not shown) blocking both ends of the shell 52*a*, a plurality of caps 52*b* and 52*c* covering both ends of the shell 52*a*, and a plurality of inner tubes (not shown) disposed to allow the other of the refrigerant and water to pass therethrough to penetrate the plurality of partitions so as to communicate with the interior of the caps 52*b* and 52*c*. Hereinafter, it is described that water passes through the plurality of caps 52*b* and 52*c* and the inner tubes and the refrigerant passes through the shell 52*a* and the plurality of inner tubes.

The condenser 52 includes a refrigerant inlet 52*d* through which a refrigerant is introduced into the shell 52*a* and a refrigerant outlet 52*e* through which the refrigerant flows out.

A first connection pipe 62 connecting the compressor 50 and the condenser 52 is connected to the refrigerant inlet 52*d* of the condenser 52.

Second connection pipes 63 and 64, comprised of a first intermediate pipe 63 connecting the condenser 52 and the supercooling heat exchanger 53 and a second intermediate pipe 64 connecting the supercooling heat exchanger 53 and the expansion instrument 54, are connected to the refrigerant outlet 52*e* of the condenser 52.

Here, as shown in FIG. 3, the condenser 52 includes a coolant outlet 52*f* to which a refrigerant outlet pipe 7B of the coolant pipe 7 is connected and a coolant inlet 52*g* to which a coolant inlet pipe 7A of the coolant pipe 7 is connected. The coolant outlet 52*f* and the coolant inlet 52*g* are formed on at least one of the plurality of caps 52*b* and 52*c* of the condenser 52.

Namely, as for the condenser 52, when the coolant pump 8 illustrated in FIG. 1 is driven, the condenser 52, the coolant cooled in the cooling top 5 is introduced into the condenser 52 to condense the refrigerant compressed by the compressor 51 and then circulated to the cooling top 5, and the refrigerant in the condensed state flows to the first intermediate pipe 63 among the second connection pipes 63 and 64.

The supercooling heat exchanger 53 serves to further cool a portion of the refrigerant condensed in the condenser 52, when the portion of the refrigerant passes therethrough. The principle of cooling the refrigerant within the supercooling heat exchanger 53 will be described later.

Meanwhile, the expansion instrument 54 expands the refrigerant cooled in the supercooling heat exchanger 53, which is configured as a capillary tube or an electronic expansion valve (EEV).

The expansion instrument 54 is connected to the supercooling heat exchanger 53 by the second intermediate pipe 64 among the second connection pipes 63 and 64.

In this manner, the refrigerant expanded by the expansion instrument 54 is introduced to the evaporator 55 through a third connection pipe 65 connecting the expansion instrument 54 and the evaporator 55.

The evaporator 55 is a water cooler which cools water by evaporating the refrigerant expanded in the expansion instrument 54, in which a refrigerant flow channel allowing a refrigerant to pass therethrough and a water flow channel allowing water to pass therethrough are formed with a heat exchanging member interposed therebetween.

The evaporator 55 is a shell-tube-type heat exchanger including a shell 55*a* allowing any one of a refrigerant and water to pass therethrough, a plurality of partitions (not shown) blocking both ends of the shell 55*a*, a plurality of caps 55*b* and 55*c* covering both ends of the shell 55*a*, and a plurality of inner tubes (not shown) disposed to allow the other of the refrigerant and water to pass therethrough to penetrate the plurality of partitions so as to communicate with the interior of the caps 55*b* and 55*c*. Hereinafter, it is described that water passes through the plurality of caps 55*b* and 55*c* and the inner tubes and the refrigerant passes through the shell 55*a* and the plurality of inner tubes.

The evaporator 55 includes a refrigerant inlet 55*d* through which a refrigerant is introduced into the shell 55*a* and a refrigerant outlet 55*e* through which the refrigerant flows out.

The refrigerant inlet 55*d* of the evaporator 55 is connected to the expansion instrument 54 by the third connection pipe 65.

A cold water outlet 55*f* to which the cold water outlet pipe 6A of the water pipe 6 as shown in FIG. 1 is connected and a cold water recovery hole 55*g* to which the cold water recovery pipe 6B is connected are formed on at least one of the plurality of caps 55*b* and 55*c* of the evaporator 55.

Namely, as for the evaporator 55, cold water cooled by the refrigerant is supplied to the air handling unit 1 through the water pipe 6 illustrated in FIG. 1 and then circulated to the evaporator 55, and the refrigerant in the evaporated state moves to the compressor 50 through the fourth connection pipe 66 connecting the evaporator 55 and the compressor 50.

In this manner, the channel along which the refrigerant is circulated, starting from the compressor 50, to pass through the condenser 52, the supercooling heat exchanger 53, the expansion instrument 54, and the evaporator 55, and to the compressor 50, will be referred to as a 'first circulation channel 100' hereinafter for the sake of explanation.

Namely, in the first circulation channel 100, the refrigerant is compressed at a high temperature and high pressure by the compressor 50 and transferred to the condenser 52 through the first connection pipe 62, the refrigerant is heat-dissipated by the condenser 52 so as to be cooled to a degree, the refrigerant is supercooled while passing through the supercooling heat exchanger 53 through the first intermediate pipe 63 among the second connection pipes 63 and 64, the refrigerant, passing through the supercooling heat exchanger 53, is changed into a low pressure liquid refrigerant while passing through the expansion instrument 54 through the second intermediate pipe 64 among the second connection pipes 63 and 64, and introduced into the evaporator 55 through the third connection pipe 65. The liquid refrigerant introduced into the evaporator 55 is phase-changed into a gas refrigerant, and then, circulated to the compressor 50 through the fourth connection pipe 66.

Here, the compressor 50 is a device for receiving the refrigerant evaporated by the evaporator 55 and changing it into a high pressure gaseous refrigerant (referred to as a 'gas refrigerant', hereinafter), and in order to smoothly operate an actual operating unit for compression and achieve durability, oil is used. Here, when oil is used within the compressor 50, it is mixed with the refrigerant and moves together with the refrigerant as it is through the first circulation channel 100.

In this respect, however, when the oil-mixed refrigerant is introduced into the evaporator 55 or the condenser 52, the heat exchange performance of the evaporator 55 or the condenser 52, serving as a sort of heat-exchanger, is degraded. Namely, a plurality of heat exchanging pipes (not shown) are disposed to allow water to pass through the refrigerant filled in the shells 52*a* and 55*a* corresponding to the interior of the evaporator 55 or the condenser 52, and in this case, the oil mixed with the refrigerant is attached to plurality of heat exchanging pipes in the shells 52*a* and 55*a*, degrading the heat-exchanging performance between the refrigerant and water.

In particular, the air conditioner according to an embodiment of the present invention further includes a second circulation channel 200 for separating oil before it is introduced into the evaporator 55 and recovering it to the compressor 50 and a third circulation channel 300 for directly separating oil from the evaporator 55 and recovering it to the compressor 50, in addition to the first circulation channel 100 as described above.

The second circulation channel 200 is branched from the first intermediate pipe 63 as a refrigerant flow channel before the refrigerant is introduced into the supercooling heat exchanger 53, and disposed to cross the first circulation channel 100 within the supercooling heat exchanger 53, and connected to the compressor 50.

Here, it is natural that the material moving along the second circulation channel 200 is the refrigerant having the oil mixed therein.

Meanwhile, a supercooling expander 68 may be installed in the second circulation channel 200 in order to expand the refrigerant introduced upon being branched from the first intermediate pipe 63.

The supercooling expander 68 is a device for expanding the oil-mixed refrigerant that goes through the second circulation channel 200 before it is introduced into the supercooling heat exchanger 53. The supercooling expander 68 serves in the same manner as that of the expansion instrument 54 installed in the first circulation channel 100.

The principle of heat exchanging between the refrigerant that goes through the first circulation channel 100 and the refrigerant that goes through the second circulation channel 200 within the supercooling heat exchanger 53 is described as follows.

Namely, as the first circulation channel 100 and the second circulation channel 200 cross within the supercooling heat exchanger 53, heat of the refrigerant of the first circulation channel 100 is taken to supercool the refrigerant that goes through the first circulation channel 100 and overheat the refrigerant that goes through the second circulation channel.

When the refrigerant of the first circulation channel is supercooled by the supercooling heat exchanger 53, the following effect can be obtained. Namely, when the refrigerant of the first circulation channel 100 is supercooled while passing through the supercooling heat exchanger 53, while the refrigerant is being evaporated from the evaporator 55, a great amount of ambient heat is taken, drastically enhancing the heat exchange performance of the plurality of heat exchanging pipes disposed in the shell 55*a* of the evaporator 55.

Also, when the refrigerant of the second circulation channel 200 is overheated by the supercooling heat exchanger 53, the following effect can be obtained. In detail, the oil-mixed refrigerant branched from the first intermediate pipe 63 among the second connection pipes 63 and 64 is primarily expanded by the supercooling expander 68 and, secondarily, the refrigerant that goes through the first circulation channel 100 is heat exchanged with heat discarded upon being generated as supercooled by the supercooling heat exchanger 53 so as to be overheated. The overheated oil-mixed refrigerant is expanded by the supercooling expander 68, obtaining the same effect as that of the case expanded by the expansion instrument 54, and is overheated by the supercooling heat exchanger 53, obtaining the same effect as that of the case evaporated by the evaporator 55. Herein, since the oil-mixed refrigerant is a low temperature/low pressure gas refrigerant, although the refrigerant is introduced through the fourth connection pipe 66, the possibility in which wet compression is generated during the process of compressing the refrigerant is scarce, whereby wet compression of the compressor 50 is prevented to increase the durability of the product.

Also, since the oil introduced into the evaporator 55 is bypassed to the compressor 50 in advance, the heat exchange performance of the evaporator 55 is further enhanced.

Namely, in the air conditioner according to an embodiment of the present invention, the refrigerant is branched from the first intermediate pipe 63 among the second connection pipes 63 and 64 to form the second circulation channel 200 and heat-exchanged, while passing through the supercooling heat exchanger 53, with the refrigerant that goes through the first circulation channel 100, whereby the overall heat exchange performance of the product can be enhanced and the durability of the product can be significantly increased.

However, it is natural that the refrigerant introduced to the evaporator 55 through the first circulation channel 100 also includes oil, and thus, an oil recovery unit (no reference numeral is used) for recovering oil from the evaporator 55 may be provided.

In general, oil recovered from the evaporator 55 by the oil recovery unit is allowed to pass through an additionally provided oil recovery tank (not shown) or oil cooling unit so as to be introduced again to the compressor 50 and reused.

Here, the recovered oil may include a refrigerant, so the air conditioner according to an embodiment of the present invention further includes the third circulation channel 300 as shown in FIG. 3.

In detail, the third circulation channel 300 is an oil movement path which is directly branched from the evaporator 55, disposed to cross the first circulation channel 100 within the supercooling heat exchanger 53, and connected to the compressor 50.

However, only the oil does not necessarily move along the third circulation channel 300, and the material moving along the third circulation channel 300 may include a liquid refrigerant.

Here, in the third circulation channel 300, the oil-mixed refrigerant recovered by the oil recovery unit is directly recovered from the evaporator 55 and passes in a crossing manner within the supercooling heat exchanger 53, so as to be overheated by using heat dissipated from the refrigerant of the first circulation channel 100.

In this manner, the observation of the refrigerant that goes through the third circulation channel 300 naturally reveals that it has the same effect as the refrigerant moving along the second circulation channel 200 as described above.

Also, referring to the oil that goes through the third circulation channel 300, it is cross heat-exchanged with the refrigerant that goes through the first circulation channel 100 within the supercooling heat exchanger 53, so the temperature of the oil rises, but as mentioned above, the oil is allowed to go through the oil cooling unit so as to be cooled, whereby the oil can be reused in the compressor 50 without causing a problem.

Meanwhile, along the third circulation channel 300, the oil-mixed refrigerant overheated by the supercooling heat exchanger 53 is introduced to the compressor 50 through a intermediate portion of the fourth connection pipe 66, like the second circulation channel 200.

Figure 4:
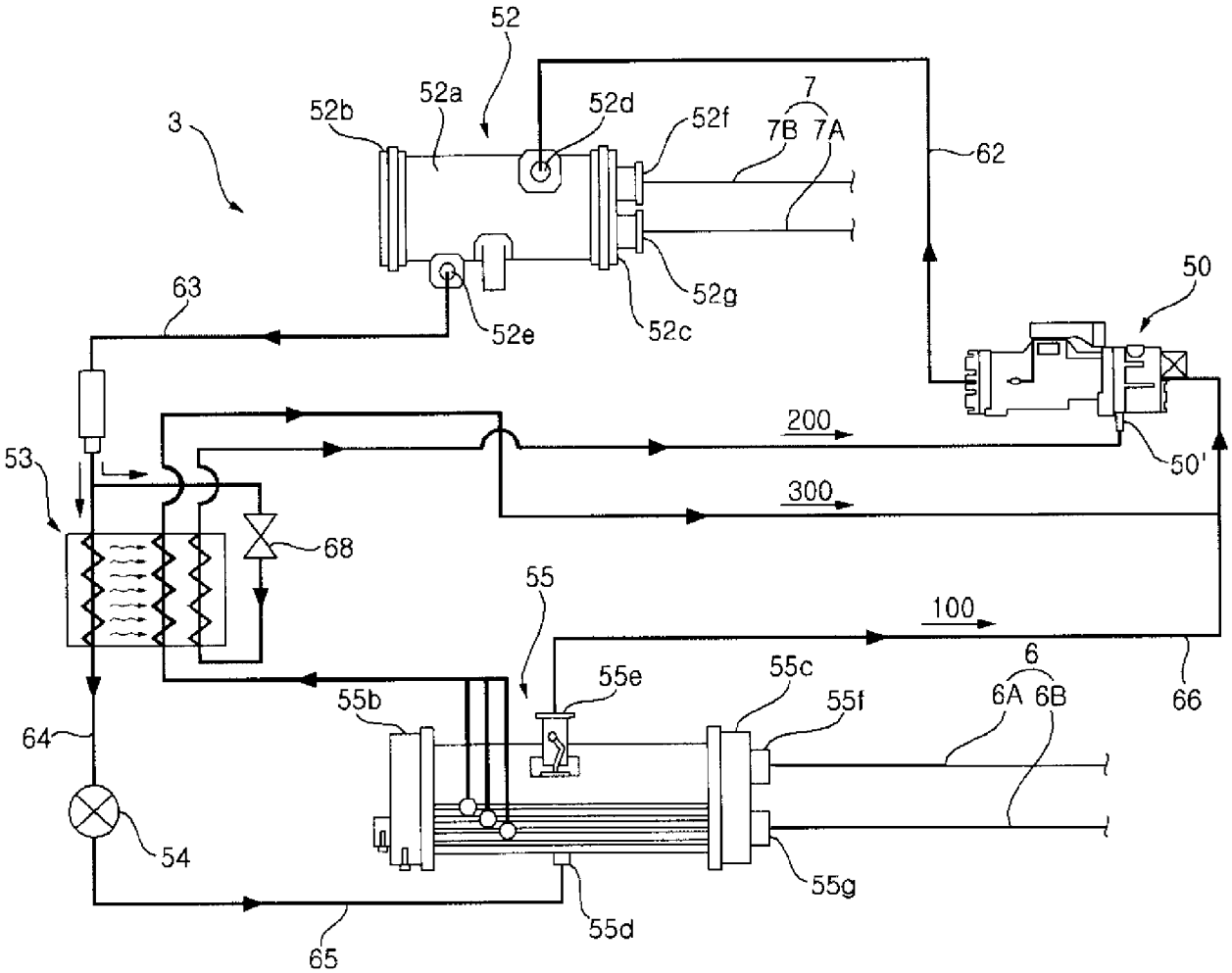
FIG. 4 is a schematic view showing the configuration of the chiller 3 of the air conditioner according to anther embodiment of the present invention.
Figure 5:
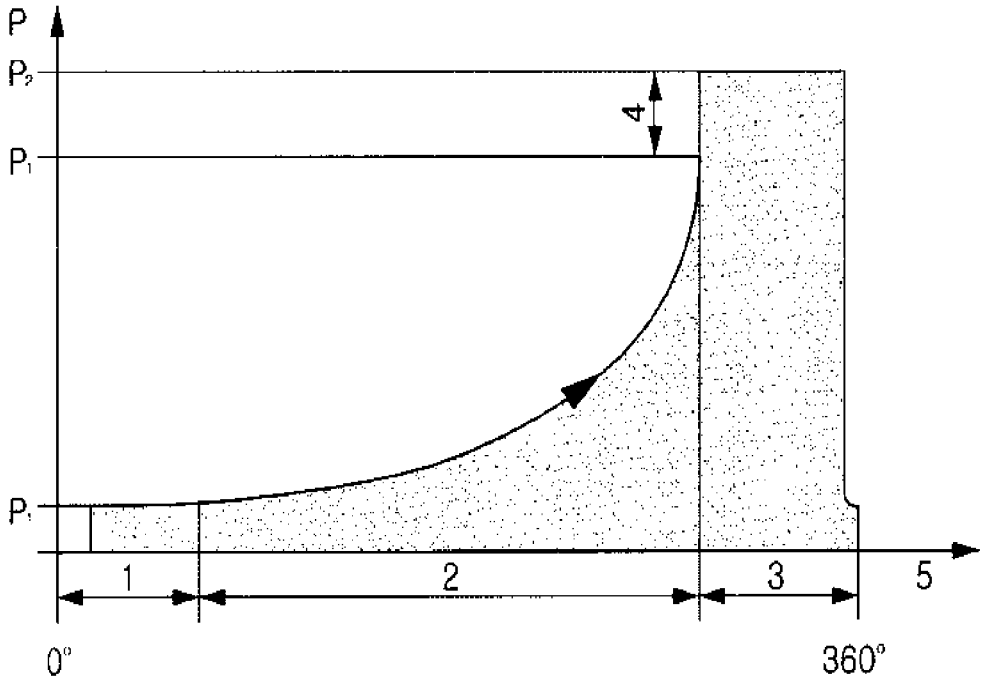
FIGS. 5 and 6 are graphs showing compression performance of a compressor in case in which a second circulation channel is connected to a fourth connection pipe and that of a compressor in case in which the second circulation channel is directly connected to the compressor.
Figure 6:
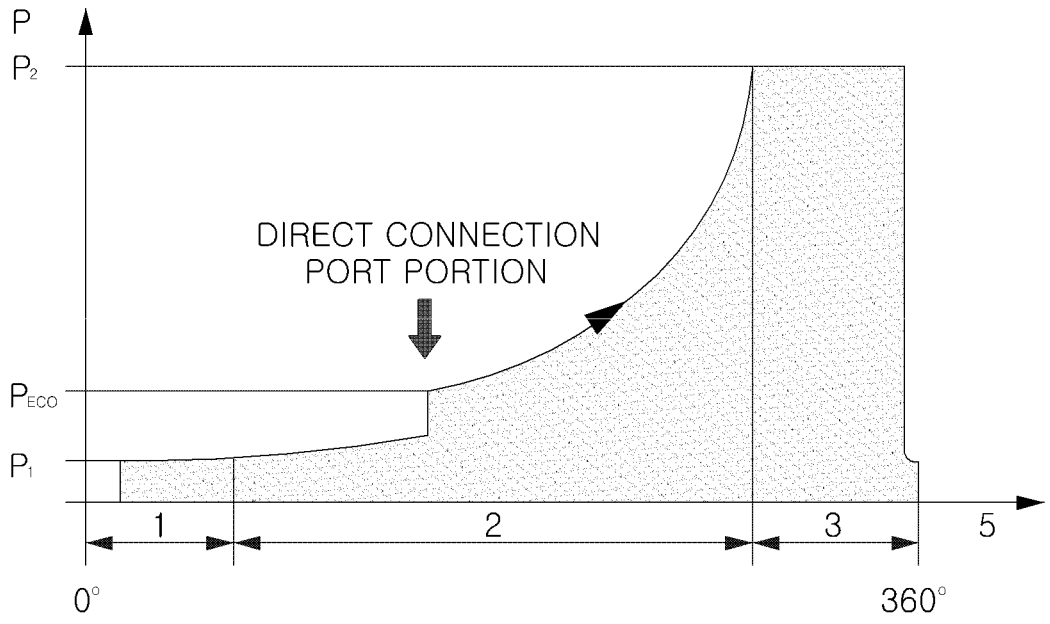

FIG. 4 is a schematic view showing the configuration of the chiller 3 of the air conditioner according to anther embodiment of the present invention, and FIGS. 5 and 6 are graphs showing compression performance of a compressor in case in which a second circulation channel 200 is connected to the fourth connection pipe and that of a compressor in case in which the second circulation channel is directly connected to the compressor.

With reference to FIG. 4, unlike the foregoing embodiment, the air conditioner according to another embodiment of the present invention is a refrigerant circulation channel in which the second circulation channel 200 is branched from the second intermediate pipe 64, disposed to cross the first circulation channel 100 in the supercooling heat exchanger 53, and directly connected to the compressor 50.

Here, besides a connection port to which the fourth connection pipe 66 is connected, a direct connection port 50' may be installed in the compressor 50, to which the second circulation channel 200 is directly connected.

When the second circulation channel 200 is connected to the direct connection port 50' directly formed in the compressor 50, since oil is supplied through the direct connection port 50' of the compressor 50, compression performance of the compressor 50 can be significantly enhanced as shown in FIGS. 5 and 6.

An operation process of the air conditioner according to an embodiment of the present invention configured as described above will be described in detail as follows.

First, a general refrigerant movement process forming the first circulation channel 100 will be described.

In the air conditioner according to an embodiment of the present invention, when the chiller 3 operates, a refrigerant is compressed to have a high temperature and high pressure by the compressor 50 and moves to the condenser 52 through the first connection pipe 62. Here, the refrigerant is in a state of a gas refrigerant mixed with oil.

Next, the gas refrigerant moved to the condenser 52 is phase-changed in the condenser 52 into a liquid refrigerant, dissipating heat to the outside. Here, the liquid refrigerant has a intermediate temperature and high pressure.

And then, the intermediate temperature and high pressure liquid refrigerant, passing through the supercooling heat exchanger 53 through the first intermediate pipe 63 among the second connection pipes 63 and 64, is supercooled, and then transferred to the expansion instrument 54 through the second intermediate pipe 64 among the second connection pipes 63 and 64. At this time, since the liquid refrigerant is supercooled, it is transferred in a low temperature/high pressure state to the expansion instrument 55, thus significantly enhancing the heat exchange performance of the evaporator 55.

The low temperature/high pressure liquid refrigerant transferred to the expansion instrument 54 is expanded into a low temperature/low pressure liquid refrigerant by the expansion instrument 54.

The refrigerant expanded into the low temperature/low pressure liquid refrigerant is transferred to the evaporator 55 through the third connection pipe 65, and evaporated by the evaporator 55, and while it is phase-changed into a gas refrigerant, it takes ambient heat.

The low temperature/low pressure gas refrigerant evaporated by the evaporator 55 is transferred again to the compressor 50 through the fourth connection pipe 66 and the compressor 50 compresses the high temperature/high pressure gas refrigerant, which is an initial stage of the foregoing refrigerant, so that the refrigerant can be compressed and reused within the thermodynamic cycle.

The most basic refrigerant movement process as described above may be the channel forming the first circulation channel 100 as described above.

Hereinafter, a refrigerant and oil movement process forming the second circulation channel 200 will be described in detail as follows.

First, when the air conditioner operates, a refrigerant and oil passing through the compressor 50 and the condenser 52 are branched from the first intermediate pipe 63 among the second connection pipes 63 and 64, pass through the supercooling expander 68 so as to be a liquid refrigerant and oil having a lowered pressure, and pass to cross the supercooling heat exchanger 53

Here, as mentioned above, the first circulation channel 100 is disposed within the supercooling heat exchanger 53, so the refrigerant that goes through the second circulation channel 200 is overheated by using heat emanated as the refrigerant of the first circulation channel 100 is supercooled, so as to be changed into a form of a gas refrigerant and particulate oil.

In this manner, the overheated refrigerant and oil are changed into the gas refrigerant and particulate oil and introduced into the compressor 50 through the fourth connection pipe 66 connecting the evaporator 55 and the compressor 50, thus preventing wet compression of the compressor 50.

As described above, the channel of the refrigerant and oil, starting from the compressor 50, flowing back to the compressor 50 through the condenser 52, the supercooling expander 68, and the supercooling heat exchanger 53 is the second circulation channel 200.

Hereinafter, a refrigerant and oil movement process forming the third circulation channel 300 will be described in detail as follows.

First, when the air conditioner operates, a refrigerant and oil compressed to have a high temperature/high pressure by the compressor 50 move up to the evaporator 55 along the first circulation channel 100.

When the refrigerant and oil is introduced into the evaporator 55, oil is separated by the oil recovery unit (not shown) installed in the evaporator 55 and the refrigerant is directly branched from the evaporator 55 to move to the supercooling heat exchanger 53.

Here, as mentioned above, the first circulation channel 100 is disposed within the supercooling heat exchanger 53, so the refrigerant and oil that go through the third circulation channel 300 is overheated by using heat emanated as the refrigerant of the first circulation channel 100 is supercooled, so as to be changed into a form of a gas refrigerant and particulate oil.

Here, the refrigerant introduced into the supercooling heat exchanger 53 already has a low temperature and low pressure by the evaporator 55, so the expansion instrument 54 is not necessary.

In this manner, the refrigerant and oil which have been changed into the gas refrigerant and particulate oil while passing through the supercooling heat exchanger 53 are introduced into the compressor 50 through the fourth connection pipe 66 connecting the evaporator 55 and the compressor 50, thus preventing wet compression of the compressor 50.

As described above, according to embodiments of the present invention, the refrigerant that goes through the second circulation channel 200 and the third circulation channel 300 is overheated by using heat discarded while supercooling the refrigerant that goes through the first circulation channel 100 by the supercooling heat exchanger 53, and then, introduced into the compressor 500 again, thus preventing a waste of energy of the product and wet compression of the compressor 50, thereby enhancing durability of the product.

The exemplary embodiments of the present invention will now be described with reference to the accompanying drawings, in which like numbers refer to like elements throughout. In describing the present invention, if a detailed explanation for a related known function or construction is considered to unnecessarily divert the gist of the present invention, such explanation has been omitted but would be understood by those skilled in the art. The accompanying drawings of the present invention aim to facilitate understanding of the present invention and should not be construed as limited to the accompanying drawings. The technical idea of the present invention should be interpreted to embrace all such alterations, modifications, and variations in addition to the accompanying drawings.

The invention claimed is:

1. An air conditioner comprising:

a first circulation channel in which a refrigerant sequentially circulates a compressor, a condenser, an expansion instrument, and an evaporator to implement a refrigerating cycle;

a supercooling heat exchanger disposed between the condenser and the expansion instrument, wherein the first circulation channel passes within the supercooling heat exchanger;

a second circulation channel which is branched from the first circulation channel between the condenser and the supercooling heat exchanger, passes within the supercooling heat exchanger, and connected to the compressor; and a third circulation channel which is directly branched from within the evaporator, passes within the supercooling heat exchanger, and is connected to the compressor, wherein the refrigerant flowing in the first circulation channel, the refrigerant flowing in the second circulation channel, and the refrigerant flowing in the third circulation channel are heat exchanged each other within the supercooling heat with exchanger.

2. The air conditioner of claim 1, wherein the compressor and the condenser are connected by a first connection pipe, the condenser and the expansion instrument are connected by a second connection pipe, the expansion instrument and the evaporator are connected by a third connection pipe, the evaporator and the compressor are connected by a fourth connection pipe, and the superheating heat exchanger is disposed between the condenser and the expansion instrument, connected to the condenser by a first intermediate pipe among the second connection pipes, and connected to the expansion instrument by a second intermediate pipe among the second connection pipes.

3. The air conditioner of claim 2, wherein the third circulation channel is a refrigerant flow channel directly branched from within the evaporator, disposed to cross the first circulation channel within the supercooling heat exchanger, and connected to the compressor.

4. The air conditioner of claim 2, wherein the second circulation channel is a refrigerant flow path branched from the first intermediate pipe, disposed to cross the first circulation channel within the supercooling heat exchanger, and connected to a direct connection port directly installed in the compressor.

5. The air conditioner of claim 2, wherein the evaporator is a shell and tube-type evaporator including a shell forming an internal space from which a refrigerant is evaporated and a tube disposed within the shell and allowing water to pass therethrough so as to be heat-exchanged with the refrigerant in the shell.

6. The air conditioner of claim 5, wherein an oil recovery unit for recovering oil within the evaporator is installed in the evaporator, and the third circulation channel is an oil recovery channel along which the oil recovered from the evaporator moves to the compressor.

7. The air conditioner of claim 6, wherein the oil recovery channel is connected to the fourth connection pipe to allow the oil recovered from the evaporator to be overheated through the supercooling heat exchanger and then introduced into the compressor.

* * * * *